US008235617B2

(12) United States Patent
Peck et al.

(10) Patent No.: US 8,235,617 B2
(45) Date of Patent: Aug. 7, 2012

(54) UNIT COMPRISING A PACKAGING CONTAINING AN APPLICATOR AND THE PRODUCT TO BE APPLIED

(75) Inventors: Christophe Peck, Mauze-Thouarsais (FR); Guy-Noel Sibileau, Saint Varent (FR); Philippe Moussion, Misse (FR)

(73) Assignee: Socoplan, Saint Jean de Thouars (FR)

( * ) Notice: Subject to any disclaimer, the term of this patent is extended or adjusted under 35 U.S.C. 154(b) by 609 days.

(21) Appl. No.: 12/417,218

(22) Filed: Apr. 2, 2009

(65) Prior Publication Data

US 2009/0279937 A1 Nov. 12, 2009

(30) Foreign Application Priority Data

Apr. 4, 2008 (EP) ..... 08300173

(51) Int. Cl.
*B43K 5/14* (2006.01)

(52) U.S. Cl. ..... 401/132; 401/126

(58) Field of Classification Search ..... 401/118, 401/127, 128, 132, 133, 126; 604/3; 206/209, 206/229, 581
See application file for complete search history.

(56) References Cited

U.S. PATENT DOCUMENTS

| | | | | |
|---|---|---|---|---|
| 4,889,228 | A | 12/1989 | Gueret | |
| 5,244,089 | A | 9/1993 | Yang et al. | |
| 5,743,279 | A * | 4/1998 | Gueret | 132/218 |
| 6,033,143 | A * | 3/2000 | Gueret | 401/129 |
| 2003/0147686 | A1 * | 8/2003 | Duqueroie et al. | 401/129 |
| 2004/0253039 | A1 * | 12/2004 | Stenton | 401/132 |
| 2006/0257199 | A1 * | 11/2006 | Sogaro | 401/132 |
| 2007/0189835 | A1 * | 8/2007 | Klocke et al. | 401/133 |
| 2009/0304433 | A1 * | 12/2009 | Peck et al. | 401/126 |

FOREIGN PATENT DOCUMENTS

| | | |
|---|---|---|
| DE | 31 22 237 | 1/1983 |
| DE | 299 64 857 | 6/1999 |
| EP | 0 323 336 | 7/1989 |
| WO | 2008/025897 | 3/2008 |

OTHER PUBLICATIONS

European Search Report dated Sep. 1, 2008, from corresponding European application.

* cited by examiner

*Primary Examiner* — Len Tran
*Assistant Examiner* — Jennifer Gordon
(74) *Attorney, Agent, or Firm* — Young & Thompson

(57) ABSTRACT

The unit (1) includes a packaging (2), an applicator (3), and a product P to be applied. The applicator (3) includes an application element (12) that is housed with the product P in a reservoir (8), an internal handling part (13) that is placed in a holding housing (11) which substantial relative rotation cannot occur. A part in the shape of a rod (14) is housed in a pipe (10) that the rod is rigid enough not to break when the packaging (2) is folded crosswise for the purpose of opening break. The unit (1) also includes two holding zones for the purpose of the break fold in a fragile transverse zone (16) with lower strength.

15 Claims, 4 Drawing Sheets

Figure 2:
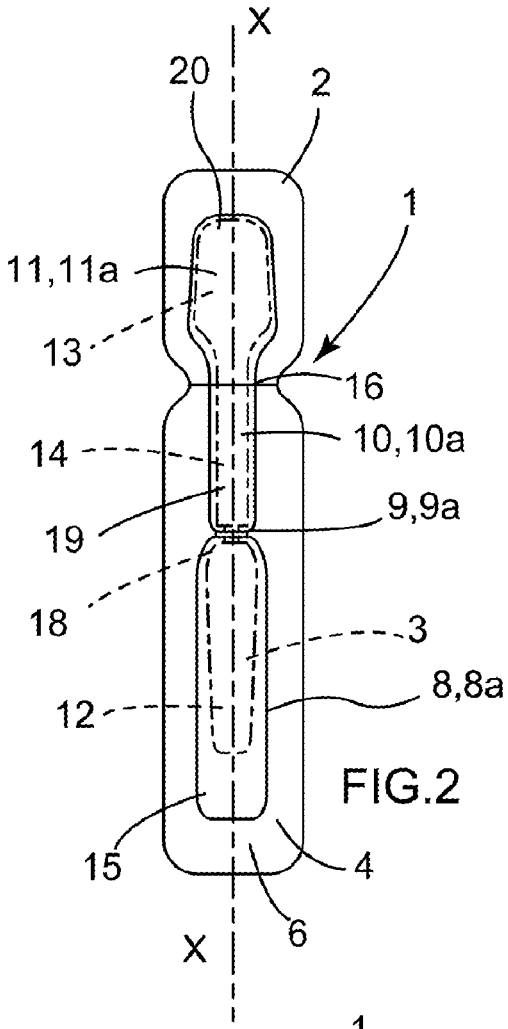

UNIT COMPRISING A PACKAGING CONTAINING AN APPLICATOR AND THE PRODUCT TO BE APPLIED

The invention relates to a unit that comprises a packaging that contains an applicator and the product to be applied.

Such a unit is provided for a single use so as to apply a product (in the liquid state or more or less solid or viscous state, and even in the more or less thickened powder state), such as a cosmetic product (for example mascara, lipstick, nail polish), a hygiene product, a personal care product, or a medication (for example, a cleaning, soothing, preventive or antiseptic composition). The product to be applied is therefore of a small amount, such as the one that corresponds to the dose that is suitable for an application or a single use for functional purposes or an esthetic use or as a sample.

The object of the invention is more specifically (i) a shell that is specially designed for a unit that comprises a packaging that consists of the shell and a closing piece, and, placed in the packaging, an applicator and a product to be applied; (ii) such a packaging that is specially designed for the production of such a unit; and (iii) such a unit that is provided for a single use so as to apply a product such as a cosmetic product, a hygiene product, a personal care product or a medication by means of an applicator.

The document WO-A-2008/025897 describes a unit of the thus defined type, comprising a packaging that contains the product to be applied and an applicator. The packaging comprises two pieces, one of which is a heat-formed shell that has a peripheral edge for interlocking with the other piece and an open part that is recessed. The other piece is either another shell that is more or less analogous to the first or a surface. The applicator comprises a rod, and, on both sides, an element for application of the product to be applied and an internal handling part. The packaging forms a closed internal space that comprises a reservoir that contains the element for application of the product to be applied and this product, ending in an opening that is formed by the two pieces of packaging, acting as a spray dryer and through which the rod of the application element passes. This opening is immediately followed by a holding housing into which is placed the internal handling part of the applicator, whereby relative substantial rotation cannot occur. The outside part of the packaging is arranged in order to be dried in the zone of the opening that forms a spray dryer.

The document EP-A-0323336 describes a disposable make-up set with two possible embodiments, the first being opening by "pulling-twisting" and the second being opening either in this same manner or by torsion.

The document FR-A-2879418 describes a distributor applicator of a product with a flexible reservoir. This distributor relies on the principle of dividing a packet into two cavities.

The documents FR-A-2738126 and U.S. Pat. No. 4,982,838 describe sample dose distributors of the same structure as the conventional make-up sets but more compact in size.

The documents U.S. Pat. No. 2,547,779 and EP-A-0171983 describe a packaging that consists of sheets that are sealed at their edges. In the document FR-A-2 625 083, the packaging comprises a first part that can be opened and a second part that contains the distribution element of the applicator, whereby the two parts are separated by a constriction zone.

The document WO 98/34512 describes a disposable sample device, having three separate pieces: a reservoir, a closing piece, and the applicator, itself consisting of several pieces. This structure is too complex and expensive for the application considered here.

The document US-A-2002/0185401 relates to a perfume test packaging. It involves an application that is completely different from the one on which the invention focuses.

The object of the invention is to produce a derivative unit of the one that is described in the document WO-A-2008/025897, cited above, with the inherent advantages, in particular the limited number of pieces and a cost appropriate to the use, but in which, in combination, the gripping is more convenient, the opening for the purpose of implementation is easier, the load of the application element in product to be applied is controlled (in terms of amount and distribution), and finally, the spraying of the product to be applied is prevented during the extraction of the application element. There is no solution for these problems in the other documents cited.

For this purpose, or according to a first aspect, the object of the invention is a shell that is specially designed for a unit that comprises a packaging that consists of the shell and a closing piece, and, placed in the packaging, an applicator and a product to be applied, the shell, heat-formed and having a certain overall rigidity, comprising a peripheral edge, secured by soldering with the closing piece, and an open median part that is recessed and that comprises:

- An enlarged part that consists of a reservoir that can accommodate the product to be applied and an application element that is part of the applicator,
- A shrunken part that ends the component part of the reservoir, consisting of an opening for passage of the application element, for distribution of the product to be applied, and for spray drying the application element that is loaded with product to be applied,
- A part that constitutes a holding housing in which is placed an internal handling part of the applicator, whereby relative substantial rotation cannot occur,
- whereby the shell also comprises a line or a fragile transverse zone of lower strength that can allow the opening of the packaging, shell in which:
- The open median part that is recessed also comprises an elongated trough that is inserted between the shrunken part that constitutes the opening for passage, distribution and spray drying, and the part that constitutes the holding housing,
- By its inside face, the trough consists of an elongated trough for metering and for distribution of the product to be applied on the application element,
- By its outside face, the trough consists of a zone for gripping the packaging for the purpose of its opening by the user,
- The line or the fragile transverse zone is located away from the shrunken part that constitutes the opening, between the trough and the part that constitutes the holding housing.

On its inside face, the trough consists of an elongated pipe that is able to prevent, or at least reduce, the spraying of the product to be applied when the applicator is being extracted.

According to one embodiment, the trough has a slightly larger inside diameter than the inside diameter of the shrunken part that constitutes the opening for passage, distribution and spray drying, whereby the inside diameter of the trough is selected for making possible the axial extraction sliding of the applicator with mild friction of its application element.

According to one embodiment, the trough and the enlarged part that constitutes the reservoir have identical or close axial lengths.

According to one embodiment, the trough has an axial length on the order of that of making possible the application by one finger or clamping between two fingers for holding the packaging when it is opened.

According to one embodiment, the shell is characterized by an open median part that comprises an enlarged part that constitutes a double reservoir that can accommodate the product to be applied and two application elements that are part of two applicators, and, on each side, a shrunken part that constitutes an opening for passage, distribution and spray drying, a part that constitutes a holding housing in which is placed an internal handling part for each of the two applicators, a line or a fragile transverse zone, and a trough.

According to one embodiment, several open median parts that are recessed and are connected by their peripheral interlocking edges, in particular by lines or zones of lower strength, are provided.

According to a second aspect, the object of the invention is a packaging that is specially designed for the production of a unit that comprises such a packaging that contains an applicator and a product to be applied, consisting of a shell as just described and a closing piece, secured by soldering, with an appropriate seal, at the peripheral interlocking edge of the shell, whereby the packaging comprises, following and in communication therewith:

A reservoir that is formed by the enlarged part of the shell and the corresponding closing part of the closing piece, An opening for passage, distribution and spray drying formed by the shrunken part of the shell and the corresponding closing part of the closing piece, An elongated pipe for metering and distribution that is formed by the trough of the shell and the corresponding closing part of the closing piece, and A holding housing that is formed by the corresponding part that constitutes the shell and the corresponding closing part of the closing piece, and whereby the packaging comprises one gripping zone for the purpose of its opening by the user, formed by the outside face of the trough, the outside face of the closing part opposite the closing piece, and the adjacent parts of the edges.

According to one characteristic, the packaging does not comprise any piece other than the shell, the closing piece and their interlocking means.

According to two different embodiments, the closing piece comes in the form of a surface or in the form of a shell.

According to one embodiment, the second closing part in surface form is a complex that comprises a barrier material of the product to be applied, such as aluminum.

According to a third aspect, the object of the invention is a unit that is provided for a single use so as to apply a product such as a cosmetic product, a hygiene product, a personal care product or a medication, whereby said unit comprises a packaging as just described, and, placed in the packaging, an applicator and a product to be applied, whereby the applicator comprises, on one side, the application element that is housed with the product to be applied in the reservoir, and, on the other side, the internal handling part that is placed in the holding housing, whereby substantial relative rotation cannot occur, and, among them, a part in the shape of an elongated rod, housed in the pipe, rigid enough not to break when the packaging is folded crosswise for the purpose of its opening break, whereby the unit comprises two holding zones for the purpose of a break fold in the line or the fragile zone of lower strength, namely a zone for gripping the packaging formed by the outside face of the trough, the outside face of the closing part opposite the closing piece, and the adjacent parts of the edges and a zone for gripping the applicator that is formed by the outside face of the holding housing, the outside face of the closing part opposite the closing piece and the adjacent parts of the edges.

According to one characteristic of the unit, to be used, the unit is gripped by the gripping zone of the packaging and by the gripping zone of the applicator, the packaging is folded crosswise without breaking the rod of the applicator so as to obtain two sub-units that can be separated from one another, the one comprising the part of the shell and the closing piece that includes the reservoir, the opening for passage, distribution and spray drying, and the elongated pipe for metering and distribution, whereby the other sub-unit comprises the applicator and the part of the shell and the closing piece including the holding housing.

According to one embodiment, the application element has a certain flexibility in the radial direction, whereby the maximum outside diameter of the application element is slightly larger than the inside diameter of the pipe for metering and distribution.

According to one embodiment, the rod of the applicator has an axial length that is identical or close to that of the trough.

According to one embodiment, a shrunken part of the applicator that is located between the application element and the elongated rod is provided, whereby this shrunken part is housed in the opening for passage, distribution and spray drying.

According to one embodiment, the internal handling part is placed in the holding housing whereby substantial relative rotation cannot occur, without being soldered to one another.

According to one embodiment in the case where the shell comprises an enlarged part that constitutes a double reservoir, the unit comprises a double reservoir and two applicators.

Figure 3:
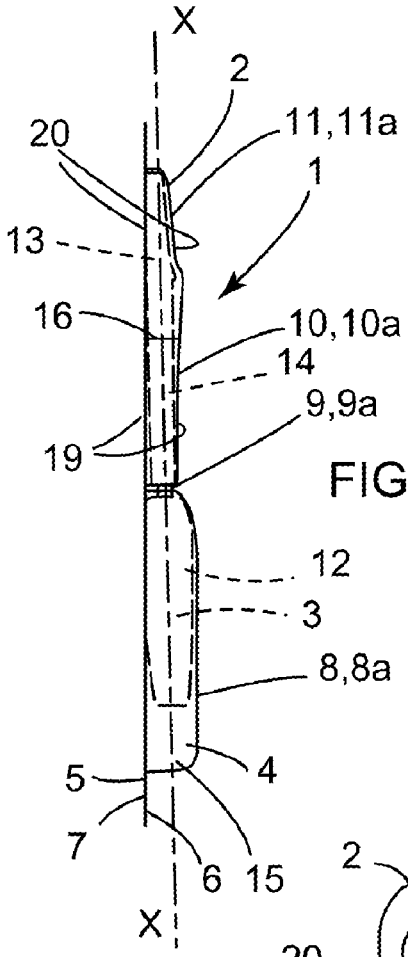
Figure 4:
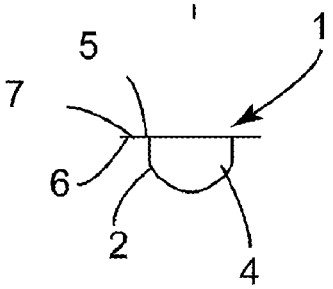
Figure 1:
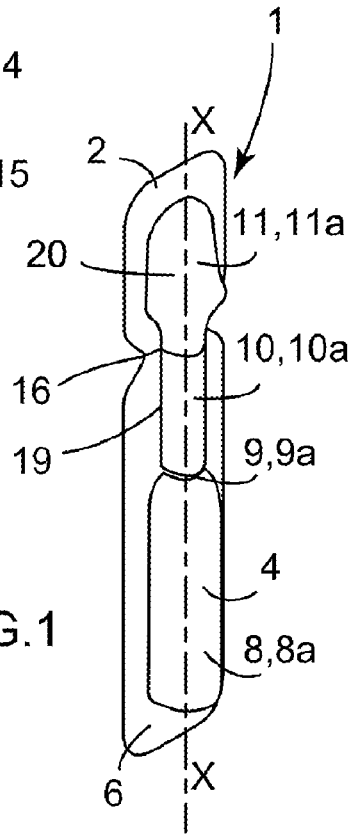
Figure 6:
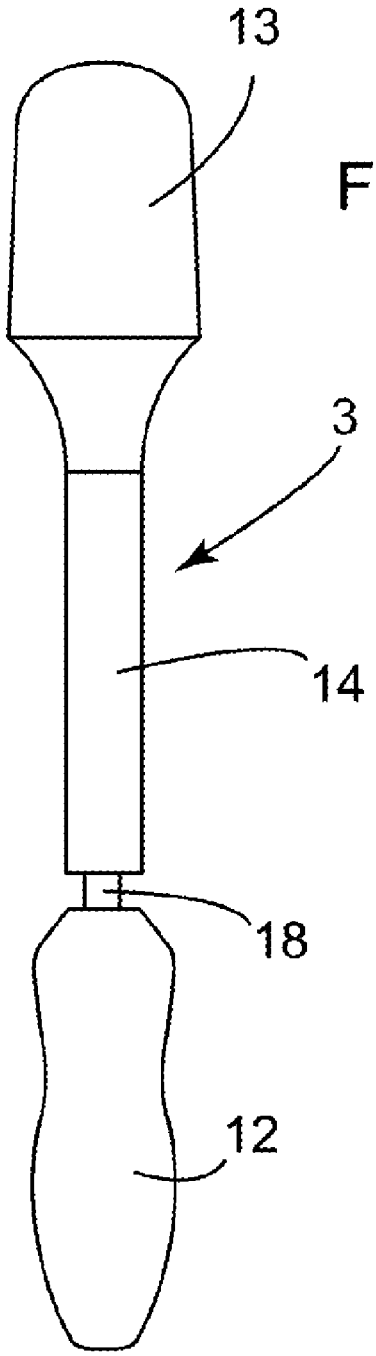
Figure 5:
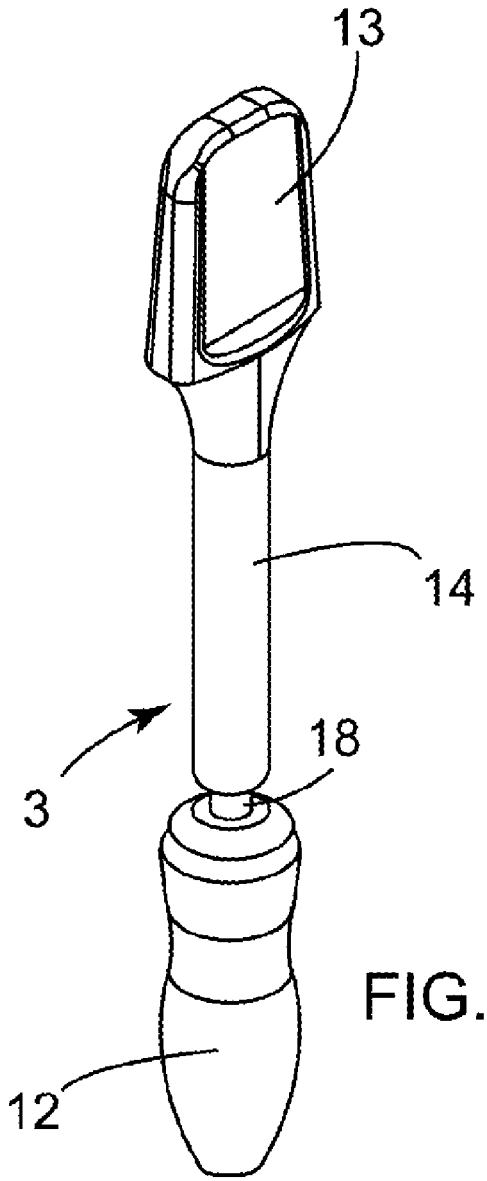
Figure 7:
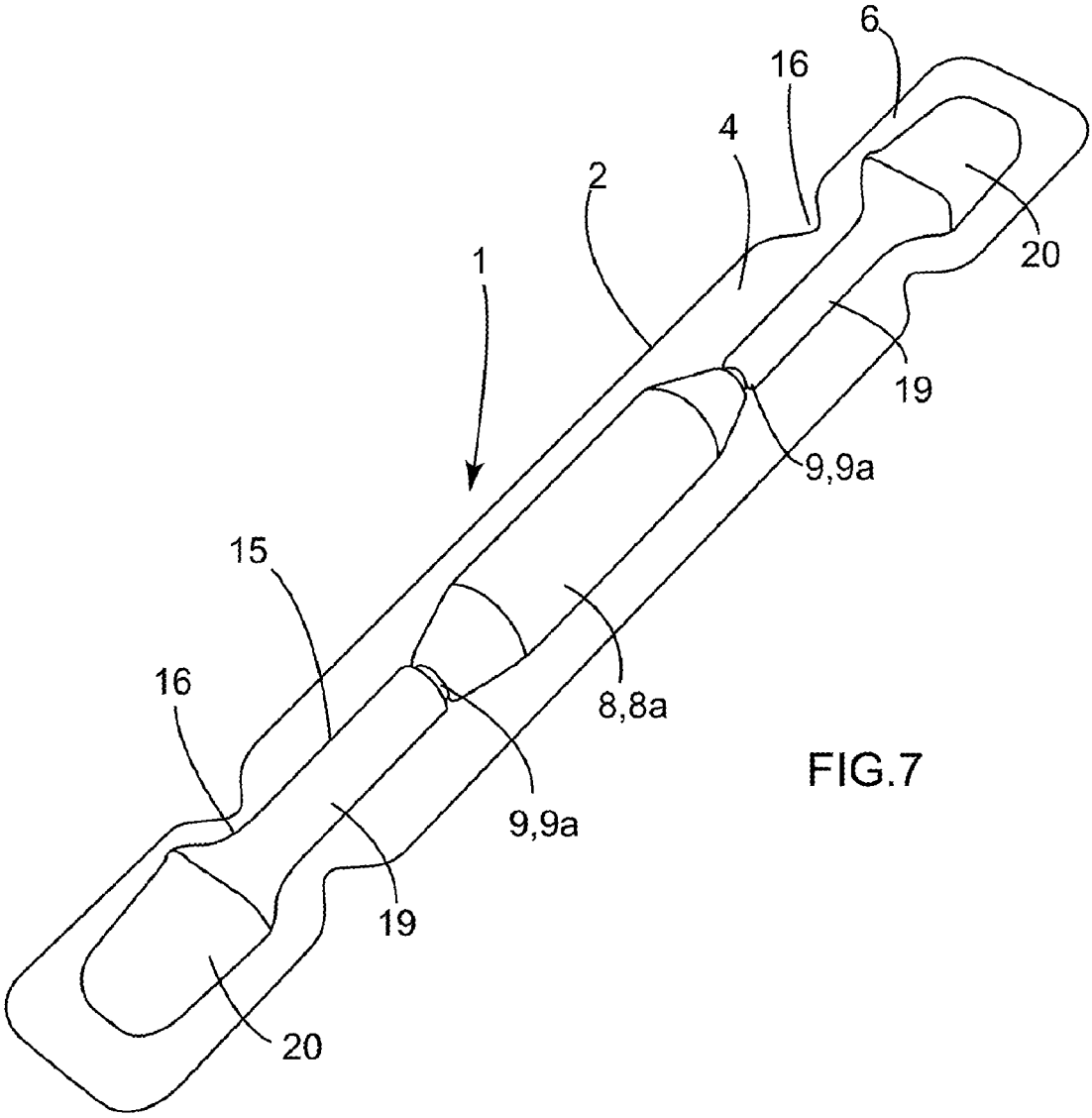
Figure 8:
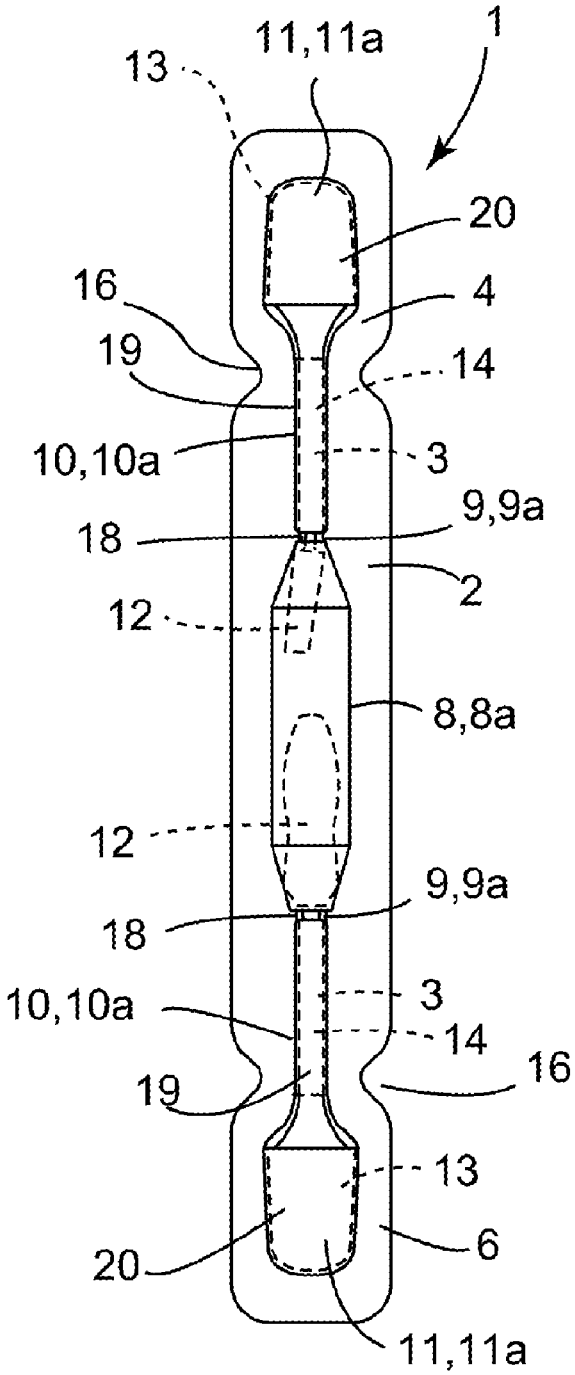
Figure 9:
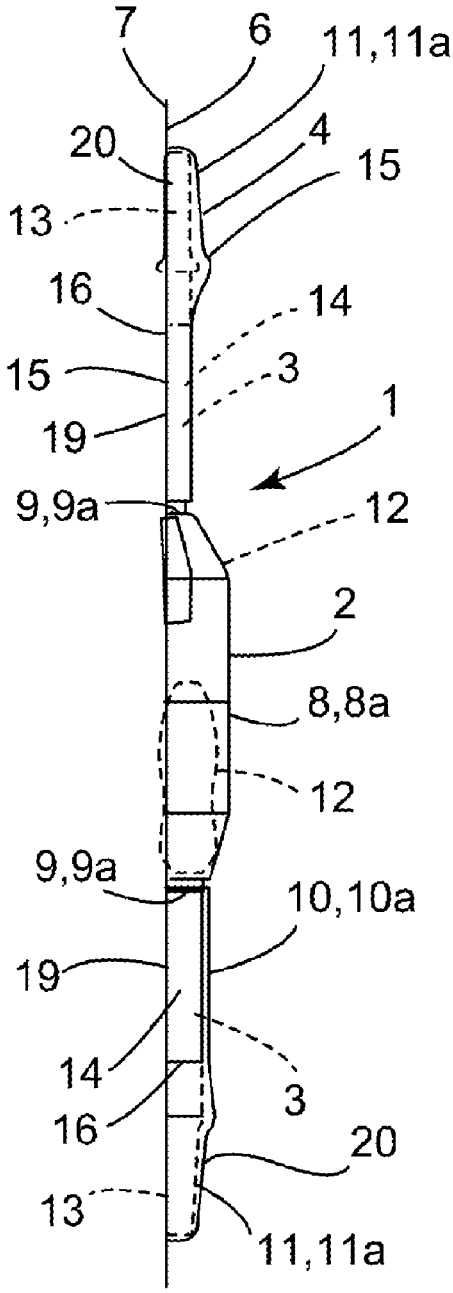

The invention will be well understood from reading the following description of several implementations and embodiments, with reference to the following figures:

FIG. 1 is a perspective view of a first embodiment with a single applicator, a unit that is provided for a single use so as to apply a product such as a cosmetic product, a hygiene product, a personal care product or a medication, on the side of the outside face of the packaging shell, FIG. 2 is an elevation view of the unit of FIG. 1, on the side of the outside face of the packaging shell, FIG. 3 is a side view of the unit of FIG. 1, FIG. 4 is an end view of the unit of FIG. 1, FIG. 5 is a perspective view, in larger scale, of a part of the applicator of the device, whereby the application element is shown only diagrammatically by its outside jacket, FIG. 6 is an elevation view of the applicator of FIG. 5, FIG. 7 is a perspective view of a second embodiment with two applicators, a unit that comprises a packaging that contains two applicators and the product to be applied, FIG. 8 is an elevation view of the unit of FIG. 7, FIG. 9 is a side view of the unit of FIG. 7.

Reference is made to the first embodiment of a unit 1 according to the invention, which is shown in FIGS. 1 to 4, having a single applicator, which is shown in FIGS. 5 and 6.

This unit 1 is provided for a single use so as to apply a product P such as a cosmetic product, a hygiene product, a personal care product or a medication.

The product P to be applied is therefore in a small amount, such as the one corresponding to the dose that is suitable for a single application or a single use for functional or aesthetic purposes or as a sample. For example, in a typical embodiment, it can be provided with on the order of 0.1 to more than 10 ml of product P.

The unit 1 comprises a packaging 2, and, placed in the packaging 2, an applicator 3 and the product P to be applied.

The packaging 2 comprises two and only two pieces, namely a shell 4 and a second closing piece 5, in addition to their interlocking means.

According to a first embodiment, shown in the figures, the second closing part 5 comes in the form of a flexible surface. Such a surface is a complex that comprises a barrier material for the product P to be applied, such as aluminum. This embodiment has the advantage of limiting the loss of product P by migration through the packaging 2.

According to a second embodiment, not shown, the second closing part 5 comes in the form of a shell that is identical or analogous to the shell 4, placed opposite shell 4.

The two pieces 4, 5 are secured by soldering, with an appropriate seal between them, by their respective two peripheral edges 6, 7 of a general flat shape, applied flat on one another.

The packaging 2 comprises an inside cavity that comprises, following and in communication therewith, a reservoir 8, an opening 9, a pipe 10, and a housing 11.

The applicator 3 comprises, on the one side, an application element 12, and, on the other side, an internal handling part 13, and between the two of them, a part in the shape of an elongated rod 14.

The shell 4 is now described more specifically.

The shell 4 is made by heat-forming, and it has a certain unit rigidity, able to effectively protect the applicator 3 and the product P, for example from the risk of crushing, ill-timed deformation and even unexpected opening or breaking.

The shell 4 first comprises the peripheral edge 6 of interlocking by soldering with the closing piece 5, whereby it has a corresponding edge 7. It then comprises a median part 15, open, recessed, located entirely on the side of the plane of the edge 6 opposite the face of the edge 6 in contact with the edge 7. This part 15 is elongated along an XX axis that defines the length of the unit 1.

This part 15, open and recessed, combined with the corresponding closing part that is placed opposite the closing piece 5, makes it possible to produce the reservoir 8, the opening 9, the pipe 10, and the housing 11. It is thus necessary to understand, as will be disclosed below, that such or such portion of the part 15, open and recessed, is a "component" of the reservoir 8, the opening 9, the pipe 10, and the housing 11.

First, the part 15, open and recessed, comprises an enlarged part 8*a* that constitutes the reservoir 8. This part 8*a* is enlarged so as to house the application element 13 there and to contain the product P to be applied.

Second, the part 15, open and recessed, comprises a shrunken part 9*a*, ending the enlarged part 8*a* that constitutes the opening 9. In the embodiment that is being considered, this shrunken part 9*a* has a minimum axial extension, being virtually completely located in a transverse plane.

Third, the part 15, open and recessed, comprises an elongated trough 10*a*, along the shrunken part 9*a*, that constitutes the pipe 10 on its inside face.

Fourth, the part 15, open and recessed, comprises a part 11*a* that constitutes the holding housing 11.

The packaging 2 thus comprises, following and in communication therewith, the reservoir 8 that is formed by the enlarged part 8*a* of the shell 4 and the corresponding closing part of the closing piece 5, the opening 9 that is formed by the shrunken part 9*a* of the shell 4 and the corresponding closing part of the closing piece 5, the elongated pipe 10 that is formed by the elongated trough 10*a* of the shell 4 and the corresponding closing part of the closing piece 5, and, finally, the holding housing 11 that is formed by the corresponding part 11*a* that constitutes the shell 4 and the corresponding closing part of the closing piece 5.

The shell 4 also comprises a line or a fragile transverse zone of lower strength 16, able to make possible the opening of the packaging 2 and the use of the unit 1.

The reservoir 8 is able to accommodate the product P to be applied and the application element 12 that is part of the applicator 3.

The opening 9 makes possible the passage of the application element 12, the distribution of the product P to be applied, and the spray drying of the application element 12 that is loaded with the product P to be applied.

The elongated pipe 10 ensures the metering and the distribution of the product P to be applied on the application element 12. It also prevents the spraying of product P to be applied during the extraction of the applicator.

For this purpose, the trough 10*a* (and the pipe 10) has an inside diameter that is slightly larger than the inside diameter of the shrunken part 9*a* (and the opening 9 for passage, distribution and spray drying). The inside diameter of the trough 10*a* (and of pipe 10) is selected in addition to make possible the axial extraction sliding of the applicator 3 with mild friction of the application element 12 on the inside face of the trough 10*a* (and of pipe 10).

In addition, the application element 12 has a certain flexibility in the radial direction, and its maximum outside diameter is slightly larger than the inside diameter of the trough 10*a* (and of the pipe 10 for metering and distribution). For example, in a typical embodiment, the application element 12 is a brush with deformable bristles that is generally cylindrical or tapered or pseudo-cylindrical or pseudo-tapered in shape or is barrel-shaped or pseudo-barrel-shaped or any other shape that is suited to the function. The application element 12 can also come in the form of a swab.

The holding housing 11 makes it possible to place the internal handling part 13 of the applicator 3 there, whereby substantial relative rotation cannot occur, and they are not soldered together. The holding, which is not necessarily a rigid and firm interlocking, results from complementary—and asymmetrical—shapes of the internal handling part 13 and the holding housing 11. In this case, these shapes are flat or pseudo-flat so as to facilitate the gripping.

Furthermore, on its outside face, the trough 10*a* consists of a gripping zone 19 of the packaging 2 for the purpose of its opening by the user, as will be seen. This gripping zone 19 is formed, in addition to this outside face of the trough 10*a*, by the outside face of the closing part opposite the closing piece 5 and the adjacent parts of the edges 6, 7.

In the embodiment that is shown, the trough 10*a* (and the pipe 10) and the enlarged part 8*a* (and the reservoir 8) have identical or close axial lengths. In one embodiment, this axial length can be on the order of 2 centimeters. In addition, this axial length is on the order of the one that makes possible the application by a finger or the clamping between two fingers for holding the packaging 2 when it is opened. Furthermore, the rod 14 of the applicator 3 has an axial length that is itself also identical or close to that of the trough 10*a* (and of the pipe 10).

The line or the fragile transverse zone 16 is located away from the shrunken part 9*a* (and the opening 9). It is located between the trough 10*a* (and the pipe 10) and the part 11*a* that constitutes the holding housing (and the holding housing 11).

As FIGS. 5 and 6 show the embodiment, a shrunken part 18 that is located between the application element 12 and the elongated rod 14 is provided on the applicator 3.

This shrunken part 18 is housed in the opening for passage, distribution and spray drying 9.

This structural arrangement makes it possible to have an opening 9 of smaller diameter than the rod 14, which ensures a more effective spray drying of the application element 12 that is loaded with product P to be applied. In this context, the presence of the pipe 10 is all the more justified since the latter makes it possible to preclude the spraying of product P to be applied at the outlet of the spray dryer.

The rod 14 of the applicator 3 is rigid enough not to break when the packaging 2 is folded crosswise for the purpose of its breaking.

The unit 1 comprises two holding zones for the purpose of such a break fold in the line or the fragile zone of lower strength 16.

A zone 19 for gripping the packaging 2 is formed by the outside face of the trough 10*a*, the outside face of the closing part opposite the closing part 5, and the adjacent parts of the edges 6, 7.

A zone 20 for gripping the applicator 3 is formed by the outside face of the holding housing 11, the outside face of the closing part opposite the closing piece 5, and the adjacent parts of the edges 6, 7. As the figures show, this holding zone 20 is flat but fairly long, whereby the resulting asymmetry is also being a means of preventing rotation.

According to a characteristic of the unit 1 relative to its implementation, first the unit 1 is gripped with the fingers by the gripping zone 19 of the packaging 2 and the gripping zone 20 of the applicator 3.

Then, the packaging 2 is folded, crosswise, without breaking the rod 14 of the applicator 3.

Then, two sub-units that can be separated from one another are obtained.

The first of the two sub-units comprises the part of the shell 4 and the closing piece 5 including the reservoir 8, the opening 9 for passage, distribution, and spray drying, and the elongated pipe 10 for metering and distribution.

The second of the two sub-units comprises the applicator 3 and the part of the shell 4 and the closing piece 5 including the holding housing 11.

The FIGS. 7, 8 and 9 show a second embodiment with two applicators 12, with a double reservoir 8.

In this case, the shell 4 comprises a part 15, open and recessed and having an enlarged part 8*a* that consists of a double reservoir 8 that can accommodate the product P to be applied and two application elements 12 that are part of two applicators 3.

On each side of this double reservoir 8, there is a shrunken part 9*a* that constitutes an opening 9 for passage, distribution and spray drying, a part 11*a* that consists of the holding housing 11 into which is placed an internal handling part 13 of each of the two applicators 3, a line or a fragile transverse zone 16, and a trough 10*a*.

According to another embodiment, several open and recessed parts 15, connected by their peripheral interlocking edges 6, 7, are provided so as to constitute a small plate of several application units.

The invention claimed is:

1. A packaging and applicator unit comprising: an applicator (3) having an application element (12) and a rod (14); a product P to be applied; and packaging, the packaging comprising:

a shell (4) and a closing piece (5), said shell and said closing piece secured together by solder to form a seal at a peripheral interlocking edge (6) of the shell (4), a reservoir (8) that is formed by an enlarged part (8*a*) of the shell (4) and a corresponding closing part of the closing piece (5), an opening (9) for passage, distribution and spray drying formed by a shrunken part (9*a*) of the shell (4) and a corresponding closing part of the closing piece (5), an elongated pipe (10) that is formed by a trough (10*a*) of the shell (4) and a corresponding closing part of the closing piece (5), the elongated pipe ensuring the metering and distribution of the product to be applied on the application element (12) of the applicator (3) and preventing spraying of the product to be applied during the extraction of the applicator (3), the inside diameter of the trough (10*a*) and the elongated pipe (10) being slightly larger than the inside diameter of the shrunken part (9*a*) and the opening (9), wherein the trough (10*a*) and elongated pipe (10), and the enlarged part (8*a*) and the reservoir (8), have identical or close axial lengths, a holding housing (11) that is formed by a constitutive part (11*a*) of the shell (4) and a corresponding closing part of the closing piece (5), a gripping zone (19) for opening of the packaging by the user, the gripping zone formed by the outside face of the trough (10*a*), the outside face of the corresponding closing part of the closing piece (5), and the adjacent parts of edges (6, 7), the gripping zone allowing for the application of a finger or the clamping between two fingers, a line or fragile zone of lower strength (16), the line or fragile zone (16) being located between the elongated pipe (10) formed by trough (10*a*) and the holding housing (11) formed by constitutive part (11 a) and being located away from the shrunken part (9*a*) and the opening (9), wherein the holding housing (11) is detachable from the remainder of the packaging by folding the unit crosswise along the line or fragile zone (16).

2. A packaging and applicator unit comprising: a shell (4) containing an applicator (3) comprising i) an internal handling part (13), ii) a rod (14), iii) a shrunken part (18), and iv) an application element (12), wherein, the rod is connected to the internal handling part at one end of the rod and the application element is connected at an other end of the rod where the shrunken part is located at the one end adjacent the rod and the application element; a closing piece (5) located opposite of the shell and interlocked with a seal at a peripheral interlocked edge (6) of the shell; a holding housing (11) comprising an applicator gripping zone (20) formed by a constitutive part (11*a*) of the shell and a corresponding closing part of the closing piece, wherein the holding housing is connected to a fragile transverse zone (16); a finger gripping zone (19) comprising i) an elongated pipe (10), ii) a trough (10*a*), and iii) an opening (9), wherein, the finger gripping zone is formed by an outside face of the trough (10*a*), the outside face being opposite of the closing piece (5), and adjacent parts of the edges (6, 7), the finger gripping zone contains the rod the of applicator inside of the shell; the fragile transverse zone is located between the elongated pipe (10) formed by the trough (10*a*) and the holding housing (11) formed by the constitutive part (11*a*), and is located away from a shrunken part (9*a*) of the shell and the opening (9), the elongated pipe for metering and distribution on the application element of the applicator is defined by the trough of the shell and the corresponding closing part of the closing piece, and configured for preventing a spraying during an extraction of the applicator, the holding housing is detachable where the fragile transverse zone is located from the finger gripping zone by folding the packaging crosswise, and an inside diameter of the trough (10*a*) and the elongated pipe (10) is slightly larger than an inside diameter of the shrunken part (9*a*) of the shell and the opening (9); and a reservoir (8) comprising an enlarged part (8a), wherein, each of the trough, elongated pipe (10*a*, 10) and the enlarged part, reservoir (8*a*, 8) have identical or close axial length, and the reservoir is connected to the finger gripping zone via the opening and the shrunken part (9*a*) of the shell.

3. The unit according to claim 2, wherein, the packaging consists essentially of the shell (4), the closing piece (5), and interlocking between the shell and the closing piece.

4. The unit according to claim 2, wherein, the shell (4) is a heat-formed shell, and further comprises an open median part (15) that is recessed and that contains i) the enlarged part (8*a*), ii) the shrunken part (9*a*) that ends the enlarged part (8*a*), iii) the trough (10*a*) that is inserted between the shrunken part (9*a*) and the constitutive part (11*a*), and iv) the line or the fragile transverse zone of lower strength (16), located away from the shrunken part (9*a*), between the trough (10*a*) and the constitutive part (11*a*).

5. The unit according to claim 2, wherein, the trough (10*a*) has a larger inside diameter than the inside diameter of the shrunken part (9*a*) and provides for axial extraction sliding of the applicator (3) with friction of the application element (12).

6. The unit according to claim 2, wherein, the trough (10*a*) has an axial length providing an application zone for a finger or a clamping zone for two fingers for holding the packaging (2) when the packaging is opened.

7. The unit according to claim 2, wherein, the closing piece (5) is one of a surface and a shell.

8. The unit according to claim 2, wherein, the closing piece (5) has an aluminum surface.

9. The unit according to claim 2, further comprising open recessed median parts connected by peripheral interlocking edges (6).

10. The unit according to claim 2, wherein the unit is for a single use; wherein, the application element (12) of the applicator is housed with a product P to be applied in the reservoir (8), and the internal handling part (13) of the applicator, is placed in the holding housing (11), wherein substantial rotation of the internal handling part (13) relative to the holding housing (11) cannot occur; the elongated rod (14) housed in the elongated pipe (10) is sufficiently rigid not to break when the packaging (2) is folded crosswise for detaching the holding housing; and the finger gripping zone (19) and the applicator gripping zone are configured for the detachment of the holding housing in the fragile transverse zone (16) with lower strength.

11. The unit according to claim 10, wherein, in use, a first and a second unit are separated from one another by an opening break action, the first unit includes a part of the shell (4), the closing piece (5) corresponding the reservoir (8), the opening (9) for passage, and the elongated pipe (10) for metering and distribution, and the second unit includes the applicator (3), a part of the shell (4), and the closing piece (5) corresponding with the holding housing (11).

12. The unit according to claim 10, wherein, the application element (12) is flexible in the radial direction.

13. The unit according to claim 10, wherein, the rod (14) of the applicator (3) has the axial length that is identical or close to a length of the trough (10*a*).

14. The unit according to claim 10, wherein, the shrunken part (18) is housed in the opening (9) allowing passage, distribution, and spray drying.

15. The unit according to claim 10, wherein, the internal handling part (13) and the holding housing (11) are not soldered together.

* * * * *